US008031044B2

(12) United States Patent
Gabathuler et al.

(10) Patent No.: US 8,031,044 B2
(45) Date of Patent: Oct. 4, 2011

(54) SWITCHING ELEMENT FOR ACTUATING AN ADJUSTABLE PARAMETER

(75) Inventors: Bruno Gabathuler, Grueningen (CH); Andi Vonlanthen, Oberrohrdorf (CH)

(73) Assignee: Phonak AG, Staefa (CH)

( * ) Notice: Subject to any disclaimer, the term of this patent is extended or adjusted under 35 U.S.C. 154(b) by 318 days.

(21) Appl. No.: 12/518,980

(22) PCT Filed: Dec. 13, 2006

(86) PCT No.: PCT/CH2006/000698
§ 371 (c)(1),
(2), (4) Date: Jun. 12, 2009

(87) PCT Pub. No.: WO2007/068136
PCT Pub. Date: Jun. 21, 2007

(65) Prior Publication Data
US 2010/0032267 A1 Feb. 11, 2010

(51) Int. Cl.
*H01C 10/00* (2006.01)

(52) U.S. Cl. ..... 338/68; 338/83; 338/89; 338/198; 200/11 A; 200/11 R

(58) Field of Classification Search ..... 338/68, 338/83, 89, 110, 118, 172, 178, 191, 198, 338/200, 201
See application file for complete search history.

(56) References Cited

U.S. PATENT DOCUMENTS

| | | | | |
|---|---|---|---|---|
| 4,652,947 | A * | 3/1987 | Oka et al. | 360/85 |
| 5,818,324 | A | 10/1998 | Richels | |
| 5,896,264 | A * | 4/1999 | Bijlenga et al. | 361/106 |
| 6,784,383 | B2 * | 8/2004 | Sugahara et al. | 200/11 R |
| 2003/0155218 | A1 * | 8/2003 | Panagl | 200/11 R |
| 2005/0178644 | A1 | 8/2005 | Moller | |
| 2010/0032267 | A1 * | 2/2010 | Gabathuler et al. | 200/11 A |

FOREIGN PATENT DOCUMENTS

| | | | |
|---|---|---|---|
| DE | 4421812 | C1 | 6/1995 |
| EP | 0311233 | A2 | 4/1989 |
| EP | 1574770 | A1 | 9/2005 |
| GB | 1153195 | A | 5/1969 |
| WO | 0235566 | A2 | 5/2002 |

OTHER PUBLICATIONS

International Search Report for PCT/CH2006/000698 dated Aug. 7, 2007.

* cited by examiner

*Primary Examiner* — James Harvey
(74) *Attorney, Agent, or Firm* — Pearne & Gordon LLP

(57) ABSTRACT

A switch element (1) for actuating a setting parameter on an electronic microdevice, such as a hearing aid, is characterized by a rotary element (7) having peripherally at least three contact points (9), said contact points being connected to one another in electrically conductive fashion. Furthermore, the switch element has an elastically mounted reset element connected with the rotary element as well as at least two electric leader contacts (3, 5), which can be switched into electrically conducting contact by turning the rotary element via the contact points.

14 Claims, 3 Drawing Sheets

SWITCHING ELEMENT FOR ACTUATING AN ADJUSTABLE PARAMETER

Figure 1A:
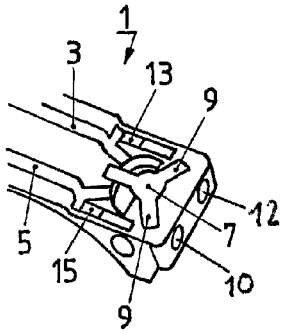

The present invention concerns a switch element according to the preamble of claim 1, a hearing aid with a switch element as well as a method for operating the switch element.

Nowadays, in-the-ear hearing (ITE) aids use digital potentiometers that can be actuated by turning a protruding knob clockwise resp. anti-clockwise with the finger. These rotary knobs serve for example to adjust the volume, to control the high/low frequencies etc. The turning movement, through a mechanism, produces a pulse-shaped on/off switching. These pulses can then be evaluated by the electronics and can set the device for example louder or less loud.

The repeated turning movement of the finger in the ear conch for this kind of volume adjustment is perceived as inconvenient. Additionally, these finger movements in the ear are transmitted as noise to the eardrum over the microphone, amplifier and receiver. These noises make the volume adjustment considerably more difficult.

The problem thus consists in finding a solution for accommodating the described components in the smallest possible space. In the state of the art, a series of solutions have been described, such as for example in EP 0,311,233, where on the battery cover of a hearing aid, two protruding contact wires are provided for actuating the volume controls. The distance between these two contact wires is very small, so that operating errors are very likely.

In the EP 1,574,770 equivalent of U.S. 2005/0178644, a rotary switch is described that has a contact spring that is operated by means of a rotary knob from or to two input contact members. The construction design is very elaborate and complicated and very unsuitable in particular for hearing aids where such a kind of volume control is to be accommodated in a very limited space.

Document U.S. Pat. No. 5,818,324 describes on the other hand a rotary knob for actuating a coil-like spring blade/wiper, where the individual coil windings are canted, and where the coil is brought into contact with a glider zone by means of turning resp. pressing the rotary knob against the spring blade.

Finally, document DE 44,21,812 discloses a rotary knob for a potentiometer, by means of which a brush collector is moved along a contact path.

The task of the present invention consists in providing a switching element, by means of which setting parameters, such as for example the volume, can be set resp. adjusted in the smallest space and for the smallest electronic devices.

For the implementation of the task, the possibility of function recognition through resistances by the electronics is used. This allows the connections on the hybrid to be reduced to two conductors and the programming contacts that are present anyway can be used for contacting and signal transmission. The switching element proposed on this basis according to the invention is characterized by the wording according to claim 1.

What is proposed is a switching element for actuating a setting parameter on an electronic device of the smallest size, such as for example a hearing aid, that has a rotary element with one at least three-star-shaped leg, where the legs are designed to be electrically conductive, and are connected conductively to one another. Also provided is a reset element connected with the rotary element and mounted elastically as well as at least two electric leader contacts that can be switched by turning the rotary element in leader contact with one another.

As already mentioned above, the function recognition occurs through resistances, where it is further proposed to contact at least one of the contacts with a resistive element in such a manner that when connecting the two contacts by turning the rotary element, the electric contact is lead via the resistive element.

In order to be able to detect the functionality of two switching operations, it is proposed to position at least two resistive elements, each connected with one of the two conducting contacts in such a manner that by means of a turning movement of the rotary element, both conducting contacts can be connected with one another in two different positions: in the first position, so that the conductive connection is lead via the one resistive element, and in the other position via the other resp. second resistive element.

Furthermore, it is proposed that the reset element is mounted elastically in such a manner that the rotary element is mounted in a position not connecting to the leader contacts when not actuated. The reset element can be for example a rocker element that is mounted elastically in such a manner that, in its resting position resp. middle position, it positions the rotary element in a position that does not connect electrically the two leader contacts.

Again, according to a further embodiment of the invention, it is possible for the star handle to be mounted elastically in axial direction in such a manner that a higher mechanical resistance counteracts the rotary element in a position pressed in the spring direction than with a released resilience.

Both leader contacts can furthermore be connected with a menu switch, by means of which the setting parameters to be operated can be determined, such as the volume, high/low balance etc. in the case of a hearing aid.

Yet again, according to a further embodiment of the invention, it is possible that the switching device proposed according to the invention is placed in the area of a battery compartment, whereby the two leader contacts can be supplied directly by the battery.

As already mentioned above, the inventive switching element is particularly suited for controlling setting parameters in hearing aids, such as in particular in-the-ear hearing aids.

Figure 1B:
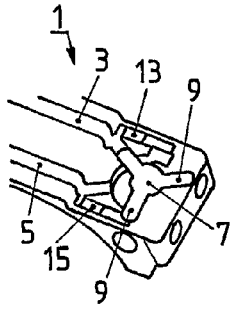
Figure 1C:
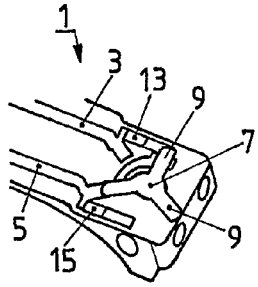
Figure 2A:
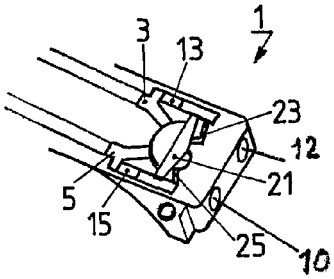
Figure 3A:
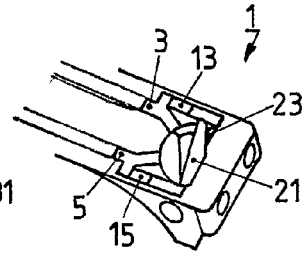
Figure 4:
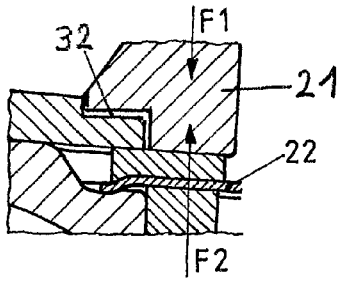
Figure 5:
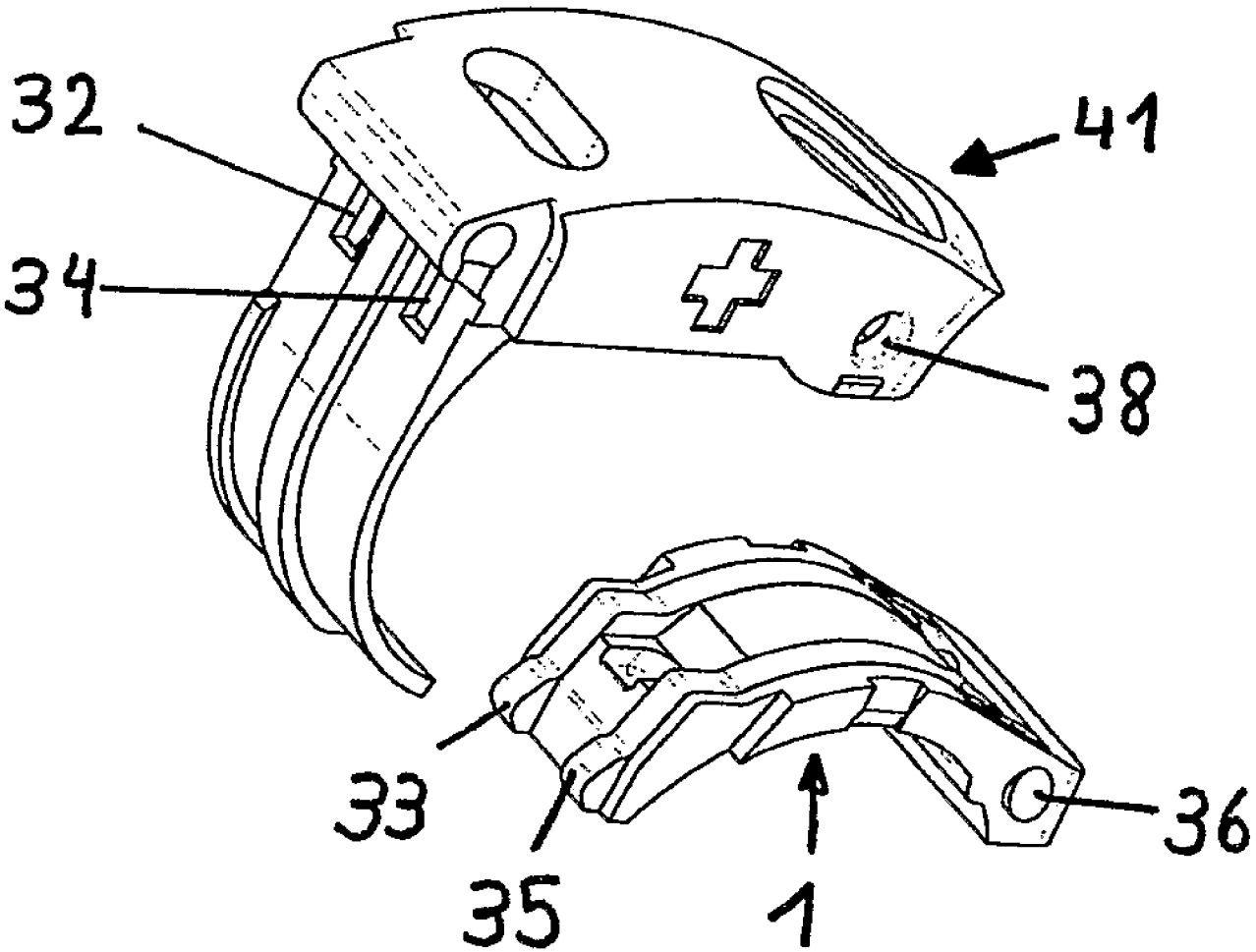
Figure 6:
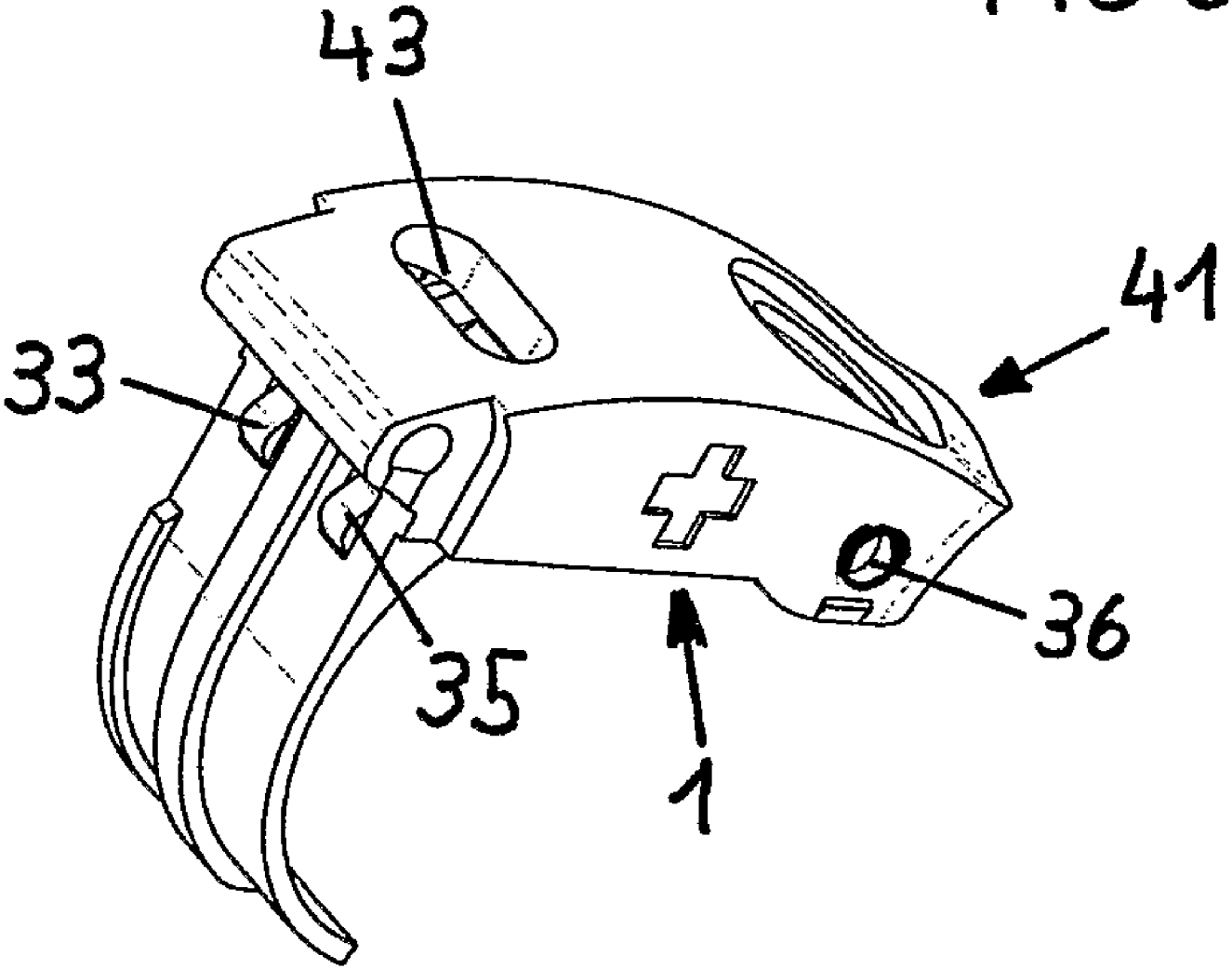

The invention will now be described in more detail by way of example and with reference to the attached figures. These show:

FIG. 1*a*-1*c* in perspective, the rotary element of the inventive switching element in resting position, in a first switching position and a second switching position, FIG. 2*a* u. 2*b* in perspective from above, the reset element in "resting position" and the rotary element in corresponding "resting position", FIG. 3*a* u. 3*b* in perspective from above, the reset element in a switching position and connected thereto the rotary element in corresponding switching position, FIG. 4 in cross section, the axial mounting of the rotary element, FIG. 5 an inventive switching element, designed to be placed on a battery compartment cover, and FIG. 6 the assembled covering of a battery compartment.

FIGS. 1*a* to 1*c* show the inventive switching element 1 in perspective from above in the three switching positions provided.

FIG. 1*a* shows the switching element in so-called "resting position", where no switching operation is triggered. The switching element includes both leader contacts 3 and 5, which are each connected at their ends with one resistive element 13 resp. 15. A rotary element resp. star handle 7 with three legs 9 arranged in a star-shape and electrically conducting and also connected conductively to one another, is provided for the electrically conductive connecting of the two leader contacts 3 and 5. In the position of the rotary elements 7 according to FIG. 1*a*, both leader contacts 3 and 5 are not connected in an electrically conductive fashion with one another.

According to FIG. 1*b*, the star handle 7 is turned clockwise to the right, so that the star-shaped legs establish a contact between the two leader contacts 3 and 5 and which leads via the resistive element 15. On the basis of the size of the resistive element, it can be determined which function resp. which setting parameter is to be changed resp. set by means of the switching element 1.

According to FIG. 1*c*, the star handle 7 is turned anti-clockwise to the left, so that by means of the star-shaped legs 9 an electric contact is established again between the two leader contacts 3 and 5, in this case however lead via the resistive element 13. Since this resistive element 13 has another resistance than the resistive element 15, it can thus be determined which function is to be triggered resp. which setting parameter is to be modified by means of the switching element. Concretely, this means that for example according to the position in FIG. 1*b*, the volume is increased on the basis of the detection of the resistive element 15, whilst according to the position in FIG. 1*c* and detection of the resistive element 13, the volume is lowered.

Figure 2B:
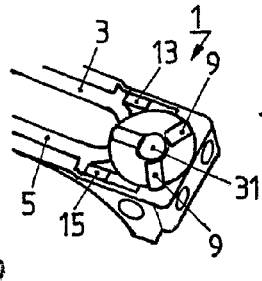

FIGS. 2*a* and 2*b* represent again in perspective view and perspectively partly in covered state how the star handle 7 resp. the star-shaped legs 9 are connected with a reset element 21. In FIG. 2*a*, the rocker-like reset element 21 is placed beneath the rotary element 7, said rocker 21 being mounted at each end on the two legs by means of the two spring resistances 23 and 25. Both spring resistances 23 and 25 are mounted in passages referenced in FIG. 1*a* with 10 and 12, and which are of course closed accordingly on the front side. The position according to FIG. 2*a* is a resting position, i.e. both springs 23 and 25 are in so-called equilibrium. FIG. 2*b* shows the rotary element covered by means of a rotary knob, where now only the star-shaped legs 9 are partly identifiable. It is clearly visible that the rotary element is in resting position, similar to FIG. 1*a*.

Figure 3B:
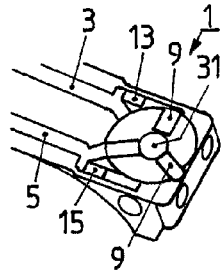

In FIGS. 3*a* and 3*b* a switching position, again in perspective from above, can be seen, where the views are similar to those of the two FIGS. 2*a* and 2*b*. In FIG. 3*a*, the rocker-like reset element 21 in tilted position is discernible, where the spring 25 is compressed and the spring 23 is released. This is possible by turning the rotary knob 31, as represented in FIG. 3*b*. In this position, the two leader contacts 3 and 5 are connected with one another via the resistive element 13. In other words, this position corresponds to that as represented in FIG. 1*c*.

It is self-evident that actuating a rotary knob of this kind is possible without problem even for extremely small dimensioning, since no fine adjustment resp. actuating for example of a wheel-like rotary part is necessary. Furthermore, it is possible to provide the rotary knob 31 with additional grooves or ribs protruding upwards, so that turning it using only one finger is even easier.

The user of a hearing aid can now in an easy manner for example increase or lower the volume by turning the rotary knob 31 of the inventive switch element 1.

FIG. 4 shows in cross section a detail of a rotary knob of the inventive switch element 1, where it can clearly be seen that the rotary element in the middle is mounted elastically in axial direction. By pressing by means of a finger in the arrow direction F1, which is possible through the provided aperture 32, an increased mechanical resistance will arise through turning, so that operating errors are to a very large extent made impossible. When releasing the axial resilience, on the other hand, the mechanical resistance does not apply, so that due to the counter force F2 of the contact spring 22, an autonomous resetting of the rotary knob resp. of the rocker 21 by means of the two springs 23 and 25 (not represented in FIG. 4) in the zero position occurs.

On the basis of the two FIGS. 5 and 6, it will be shown how a switch element 1 proposed according to the invention can be positioned usefully in an electronic device of the smallest size such as for example a hearing aid. The positioning in the area of a battery compartment resp. integrated in a cover 41 for closing a battery compartment is preferred. This cover 41 can be designed in such a way that a switch element 1 can be placed by insertion or clicking-in in the housing into recesses 32, 34 and 38 by means of connectors 33 and 35 as well as cams 36. On the backside, both connectors 33 and 35 can protrude out of the cover.

FIG. 6 shows the switch element 1 in a state inserted in the housing 41. It is furthermore possible to provide in the battery compartment cover 41 an additional opening 43, for example for operating a menu switch that is connected with both contact connectors 33 and 35. By means of this menu switch it is possible optionally to choose from among different setting parameters that are to be adjusted resp. actuated with the inventive switch element. Again, in the case of a hearing aid, this can be adjusting the volume, controlling the high/low frequencies, controlling the suppressing or allowing of influence of ambient noise, etc.

The case of the switch element represented with reference to FIGS. 1 to 6, for example the case of a potentiometer, is only an example of embodiment that serves only to better understand the present invention. It is of course possible to execute the rotary element in another manner, to provide instead of a rocker-like reset element a reset element mounted by means of a circular spring, to provide instead of two-leader-contacts several leader contacts that can be connected differently to one another depending on the rotation deflection, etc. etc.

On the basis of the present invention, it is explained how the detection of a switch state resp. of a potentiometer rotational direction via resistances, as in the present case, occurs via at least two different resistances. This arrangement allows a program switch, which decides how and in which manner a setting parameter is changed resp. set, to be detected during a short circuit of both conductive paths before the potentiometer. Additionally, it is of course also possible to achieve via the short circuit and via the for example two resistances further functions in the same arrangement, for example the battery cover, such as for example an additional program switch. Furthermore, it is also possible to connect a further menu switch with the two conductive paths in order to determine each time which setting parameter is modified resp. adjusted.

Through the connection of the potentiometer and the program switch over two contacts and placed for example in the battery cover, the number of component parts to be produced for electronic device of the smallest size, such as for example hearing aids, are considerably reduced. Additionally, the switch element proposed according to the invention is easy and reliable to use, so that switching errors resp. operating errors can be reduced resp. excluded. Yet another advantage of the switch element proposed according to the invention, especially in connection with the mentioned battery cover, results in different operating controls can be placed on one and the same hearing aid. The fitting of the operating controls can thus be carried out even by the acoustician and thus the acoustician can offer his customers several options without the hearing aid having to be converted in the laboratory. This causes neither costs nor delays for the customer.

A further advantage is the utilization of space on the battery compartment for the operating controls. This allows the microphone to be placed more freely and the hearing aid can accordingly be built small.

What is claimed is:

1. Switch element (1) for actuating a setting parameter on an electronic microdevice, such as a hearing aid, characterized by a rotary element (7) having peripherally at least three contact points (9), said contact points being connected to one another in electrically conductive fashion, an elastically mounted reset element (21) connected with the rotary element as well as at least two electric leader contacts (3, 5), which can be switched into electrically conducting contact by turning the rotary element via the contact points.

2. Switch element according to claim 1, characterized in that a rotary element (7) having an at least three-star-shaped leg (9) is provided, where the legs are designed to be electrically conductive, and are connected conductively to one another.

3. Switch element according to claim 1, characterized in that a resistive element (13, 15) connected with at least one of the leader contacts is provided in such a manner that when the two leader contacts (3, 5) are connected by means of the rotary element respectively of the contact points, the electric contact is lead via the resistive element (13, 15).

4. Switch element according to claim 1, characterized in that at least two resistive elements (13, 15) are provided and that by means of the rotary element respectively via the contact points (9) the two leader contacts can be connected with one another in two different positions in such a manner that in the first position the electric connection is lead via the one resistive element, and in the other position via the other respectively second resistive element.

5. Switch element according to claim 1, characterized in that the reset element (21) is mounted elastically in such a manner that the rotary element when not in use is driven in a position not connecting the leader contacts.

6. Switch element according to claim 1, characterized in that the reset element is a to-and-fro rocker that is mounted each in the region of both ends by means of a spring.

7. Switch element according to claim 1, characterized in that the rotary element, executed as star-shaped star handle, is mounted elastically in axial direction in such a manner that in a position of the rotary element respectively star handle pressed in the spring direction, during a turning movement a higher mechanical resistance counteracts than with a released resilience.

8. Switch element according to claim 1, characterized in that the two leader contacts are connected with a menu switch, by means of which the setting parameters to be influenced can be determined, such as in the case of a hearing aid the volume, high/low balance, ambient noise on/off, etc.

9. Switch element according to claim 1, characterized in that, in the sense of a potentiometer, it is positioned in the area of a battery compartment of the electronic microdevice, such as in particular in the battery compartment of a hearing aid.

10. Hearing aid with a switch element respectively a potentiometer according to claim 1.

11. Method for operating a switch element according to claim 1, characterized in that the rotary element connected with the reset element, having peripherally the at least three contact points that are connected to one another in electrically conductive fashion, is rotated from a resting position into a first operating position, so that the two leader contacts can be connected with one another, where in a first position the connection occurs via a first resistive element, and by moving the rotary element into a second position, so that the two leader contacts can be connected in electrically conductive fashion via a further resistive element, in order to functionally adjust a setting parameter of an electronic microdevice depending on the detected resistive element.

12. Switch element according to claim 2, characterized in that a resistive element (13, 15) connected with at least one of the leader contacts is provided in such a manner that when the two leader contacts (3, 5) are connected by means of the rotary element respectively of the contact points, the electric contact is lead via the resistive element (13, 15).

13. Switch element according to claim 2, characterized in that at least two resistive elements (13, 15) are provided and that by means of the rotary element respectively via the contact points (9) the two leader contacts can be connected with one another in two different positions in such a manner that in the first position the electric connection is lead via the one resistive element, and in the other position via the other respectively second resistive element.

14. Switch element according to claim 3, characterized in that at least two resistive elements (13, 15) are provided and that by means of the rotary element respectively via the contact points (9) the two leader contacts can be connected with one another in two different positions in such a manner that in the first position the electric connection is lead via the one resistive element, and in the other position via the other respectively second resistive element.

* * * * *

UNITED STATES PATENT AND TRADEMARK OFFICE

CERTIFICATE OF CORRECTION

PATENT NO. : 8,031,044 B2
APPLICATION NO. : 12/518980
DATED : October 4, 2011
INVENTOR(S) : Bruno Gabathuler et al.

It is certified that error appears in the above-identified patent and that said Letters Patent is hereby corrected as shown below:

On the title page, item (75), please change the city of residence for the inventor Bruno Gabathuler from "Grueningen" to -- Staefa --

On the title page, item (75), please change the city of residence for the inventor Andi Vonlanthen from "Oberrohrdorf" to -- Remetschwil --

Signed and Sealed this
Third Day of January, 2012

David J. Kappos

David J. Kappos
*Director of the United States Patent and Trademark Office*